US009660328B2

(12) United States Patent
Wild

(10) Patent No.: US 9,660,328 B2
(45) Date of Patent: May 23, 2017

(54) MOUNTING ASSEMBLY FOR AN INTEGRATED REMOTE RADIO HEAD AND ANTENNA SYSTEM

(71) Applicant: John Mezzalingua Associates, LLC, Liverpool, NY (US)

(72) Inventor: Werner Wild, Buttenwiesen (DE)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 14/755,779

(22) Filed: Jun. 30, 2015

(65) Prior Publication Data

US 2015/0380806 A1 Dec. 31, 2015

Related U.S. Application Data

(60) Provisional application No. 62/019,111, filed on Jun. 30, 2014.

(51) Int. Cl.

| | |
|---|---|
| ***H01Q 1/50*** | (2006.01) |
| ***H01Q 1/24*** | (2006.01) |
| ***H01Q 1/12*** | (2006.01) |

(52) U.S. Cl.
CPC ..... *H01Q 1/246* (2013.01); *H01Q 1/12* (2013.01)

(58) Field of Classification Search
CPC ..... H01Q 1/12; H01Q 1/246
USPC ..... 343/906
See application file for complete search history.

(56) References Cited

U.S. PATENT DOCUMENTS

| | | | | |
|---|---|---|---|---|
| 6,232,928 | B1 * | 5/2001 | Zimmerman | H01Q 1/1242 343/882 |
| 6,768,474 | B2 * | 7/2004 | Hunt | H01Q 1/125 248/218.4 |
| 7,576,705 | B2 * | 8/2009 | Greenfield | H01Q 1/1242 343/890 |
| 9,172,421 | B2 * | 10/2015 | Colapietro | H04B 1/40 |
| 2014/0179244 | A1 * | 6/2014 | Colapietro | H04B 1/40 455/90.2 |

* cited by examiner

*Primary Examiner* — Khai M Nguyen
(74) *Attorney, Agent, or Firm* — Barclay Damon, LLP

(57) ABSTRACT

A mounting assembly for a remote radio head, in one embodiment, comprising a body configured to hold the remote radio head and a mounting system to detachably couple the body to an antenna housing. The mounting system configured to facilitate alignment of the remote radio head ports with the antenna ports.

13 Claims, 6 Drawing Sheets

MOUNTING ASSEMBLY FOR AN INTEGRATED REMOTE RADIO HEAD AND ANTENNA SYSTEM

CROSS-REFERENCE TO RELATED APPLICATION

This application is a non-provisional, and claims the benefit and priority, of U.S. Provisional Patent Application No. 62/019,111, filed on Jun. 30, 2014. The entire contents of such application are hereby incorporated by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyrights whatsoever.

BACKGROUND

An outdoor wireless communication network typically includes a cell site having a base station, a cell tower, and a plurality of macro antennas mounted to the cell tower. The macro antennas are powered and arranged to transmit wireless broadband signals to communication devices, e.g., cell phones, within a defined area, typically, an area spanning about one (1) to two (2) miles. Received signals are transmitted upstream to a service provider and forwarded downstream to a destination cell tower or, if a cellular call spans a large distance such as might happen when making an international call, via a communications satellite.

The base station may include a tower, mounting a plurality of exterior antennas and Remote Radio Units (RRUs) and a ground shelter proximal to the tower, enclosing a variety of base station equipment. A plurality of exterior antennas and remote radio heads (RRHs) are mounted to the tower. Each RRH is operatively coupled, and mounted adjacent to, a group of associated macro antennas. Furthermore, each RRH manages the distribution of signals between its associated macro antennas and the base station equipment. The base station equipment may include electrical hardware operable to transmit/receive radio signals and to encrypt/decrypt communications with a mobile telephone switching office. The base station equipment also includes power supply units and equipment for powering and controlling the antennas and other devices mounted to the tower.

A distribution line, such as coaxial cable or fiber optic cable, distributes signals that are exchanged between the base station equipment and tower-mounted antennas however, transmission losses occur that can exceed several decibels. Remote radio heads are employed to mitigate such transmission losses. More specifically, RRHs move key base station radio frequency (RF) circuitry proximal to the macro antenna ("remotely" from the base station), to minimize the length of coaxial cable and the losses between the base station and the antenna. Additionally, remote radio heads typically have operation and management processing capabilities and a standardized optical interface to connect to the remainder of the base station.

Presently, each macro antenna may be configured to transmit up to nine hundred (900) distinct frequency bands or channels. While each antenna may transmit any one of the available frequency bands, RRUs are configured to uplink/downlink only a fraction of the total available bands due to a variety of technical and business issues, including the license fees associated with broadband usage, i.e., fees charged by the Federal Communications Commission or "the FCC." Remote radio heads are routinely deployed and removed depending upon the availability of broadband signals and customer requirements. There is a burden associated with deploying RRHs which are configured for each of the many frequency bands transmitted by the service providers.

While the use of an RRH mitigates signal degradation, i.e., by minimizing the length of coaxial cable, the transition from fiber-to-cable (internally of the RRH) and from cable-to-fiber (internally of the antenna), continues to adversely impact signal performance and efficiency. Cabling internally of the tower-mounted antenna can also produce difficulties inasmuch as the internal space is confined and real estate at a premium.

Additionally, each of the existing towers is rated for a particular "sail load", or load imposed by aerodynamic drag. As the number of radio heads increase on a cell tower, the aerodynamic drag increases as a function of the cumulative profile area. The additional drag may or may not be within the bending moment design criteria or allowables of the cell tower.

Finally, as number of broadband channels increase, i.e., the number which become available via the FCC, so too does the number of service providers. And, as the number of service providers increase, so too will the number of macro antennas and RRHs. As a consequence, the cost associated with managing the implementation of the new antennas and RRHs continues to grow. The present business environment requires a degree of flexibility which does not exist with the current RRHs/antenna systems employed in the field.

The foregoing background describes some, but not necessarily all, of the problems, disadvantages and shortcomings related to: (i) signal transmission losses between the base station and tower-mounted antennas, (ii) the need for multiple RRHs on a cell tower, (iii) the aerodynamic drag associated with multiple RRHs, and (iv) the deployment and complexity associated with multiple RRHs.

SUMMARY

The present disclosure describes a mounting system for a RRH that decreases the transmission loss between the base station components and the tower-mounted antenna as well as the aerodynamic drag created by the radio heads themselves. In addition, the mounting system disclosed enables an installer to easily deploy one or more RRHs and complete multiple connections and types of connections between the RRH and the tower-mounted antenna simultaneously.

In one embodiment, a RRH housing comprises a body configured to hold a radio head, the radio head comprising a plurality of radio head ports, and the body defining a plurality of openings which provide access to the radio head ports. A mount engager is coupled to the body, the mount engager is configured to engage a mount of an antenna housing. A port aligner is coupled to the body, the port aligner is configured to mate with a portion of the antenna housing.

In another embodiment, a mounting system is provided for connecting a RRH to a tower mounted antenna comprising a mounting arrangement configured to detachably connect the RRH to the antenna and a connector including first and second portions. Each of the first portion and second portions is electrically connected to one of the radio head and the antenna. Furthermore, the detachable mounting arrangement utilizes the force of gravity to augment the connection of the of the first and second portions of the connector.

In another embodiment, a radio head mounting arrangement comprises at least one radio head configured to detachably mount to an antenna and at least one connector including a first portion and a second portion disposed in a face-to-face relationship. The first portion and the second portion are electrically connected to one of the at least one radio head and the antenna. In one embodiment, the first and second portions are each located below the center-of-gravity of the radio head such that the force of gravity facilitates the coupling of the first and second portions.

Additional features and advantages of the present disclosure are described in, and will be apparent from, the following Brief Description of the Drawings and Detailed Description.

DETAILED DESCRIPTION

Figure 1:
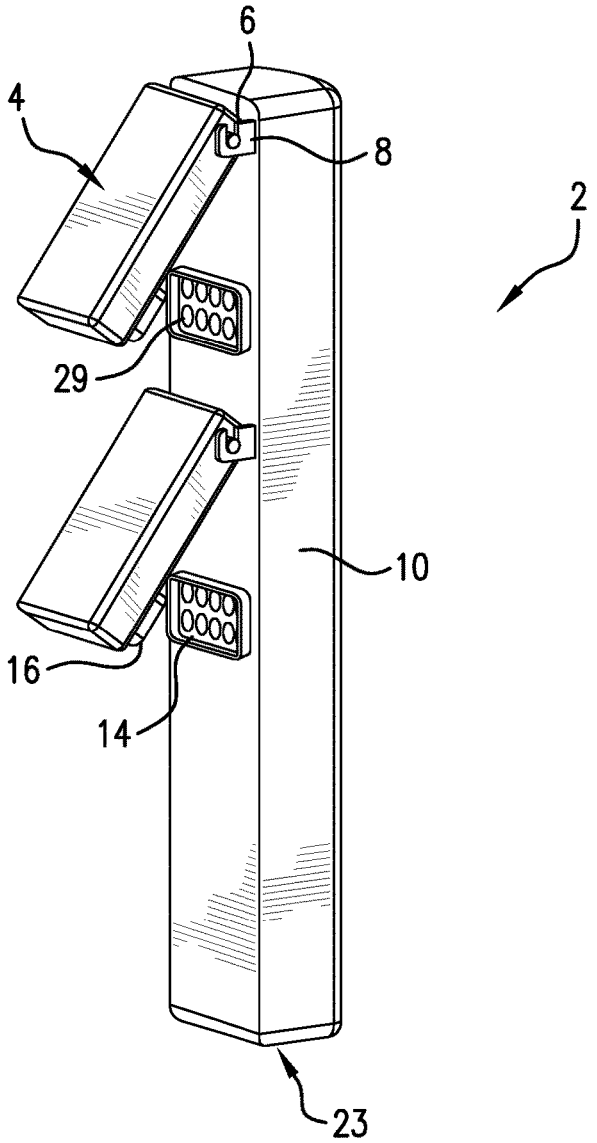
FIG. 1 is an isometric view of an integrated Remote Radio Head (RRH)/antenna system comprising multiple RRHs.
Figure 2:
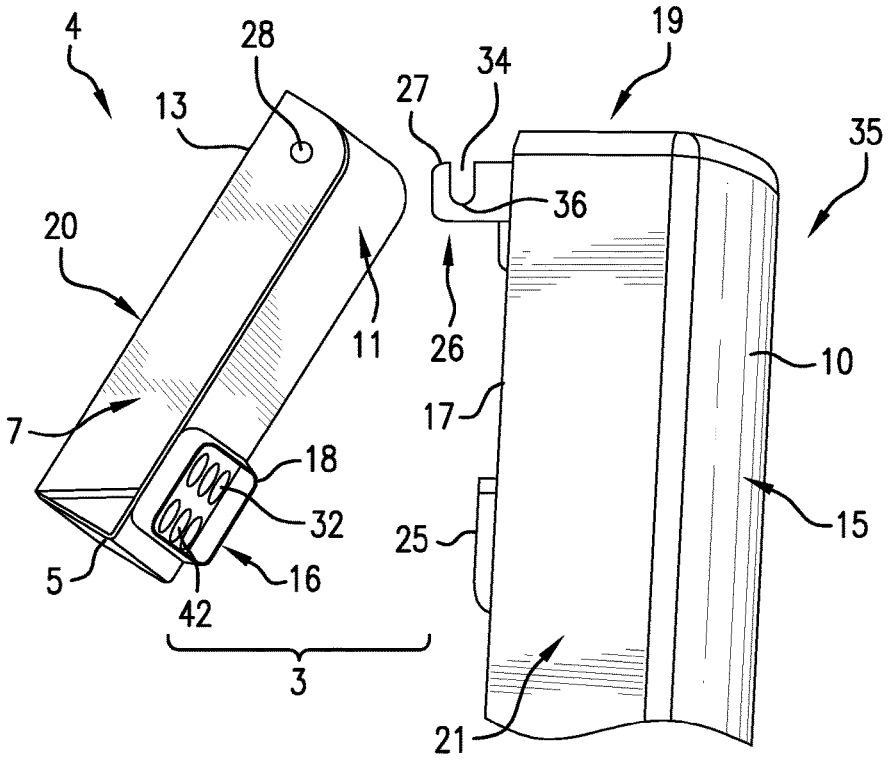
FIG. 2 is an isometric view of the integrated RRH/antenna system prior to mounting the RRH in combination with the antenna.

Referring to FIGS. 1 and 2, the integrated RRH/antenna system 2 comprises multiple RRH housings 4, each with a mount engager 6. As shown, the mount engagers 6 are coupled to the mounts 8 of the a tower-mounted antenna housing 10. Coupling the mount engager 6 to the mount 8 aids to align the ports 32 of the first portion 16 of the connector with the ports 12 of the second portion 14. Alignment is aided by one or more port aligners 18 operative to guide the first and second portions 16, 14 of the connector and the corresponding ports 32,12 on each portion 16, 14 into proper alignment for secure engagement.

Referring to FIG. 2, the RRH housing 4 comprises a main body 20 that houses the electronic components of the RRH 42. The main body 20 includes lateral side surfaces 7, a bottom surface 5, a top surface 9, a back surface 11 and a front surface 13. The front surface 13 of the main body 20 is configured to allow access to the ports 32 of the radio head through a series of openings. The tower-mounted antenna housing 10 comprises a main body 35 that includes a front surface 15, a rear surface 17, lateral side surfaces 21, a top surface 19 and a bottom surface 23 (see FIG. 1). The RRH housing 4 and the antenna housing 10 include a mating surface that is configured to interface with a portion of the port aligner 18. Such mating facilitates port alignment as the first and second portions 16, 14 of the connector 3 are brought into engagement.

In one embodiment, the mounting arrangement comprises a detachably, pivot-mounted, open-ended clevis wherein the mount 8 comprises two or more U-shaped brackets 26 and wherein the mount engager 6 comprises a horizontal pin 28. The U-shaped brackets 26 include a forward wall 27, an opening 34 and a bearing surface 36. In this embodiment, a horizontal pin 28 projects from each lateral side surface 7 of the RRH housing 4. The opening 34 is configured to accept the horizontal pin 28 and the bearing surface 36 is configured for the horizontal pin 28 to rest.

It will be appreciated that other embodiments may include a horizontal pin 28 projecting from a surface of the RRH other than the lateral side surface 7. It will further be appreciated that other embodiments may be employed where the U-shaped brackets 26 and the horizontal pin 28 are disposed on surfaces of the antenna 10 and RRH housings 4, respectively. The U-shaped brackets 26 are configured to support the weight of the RRH and may be coupled to the antenna housing 10 using bolts, screws, one or more welds or any means appropriate for achieving this purpose. In some embodiments, the U-shaped brackets 26 may be integrated with and molded from the same material as the antenna housing 10 itself.

Figure 3A:
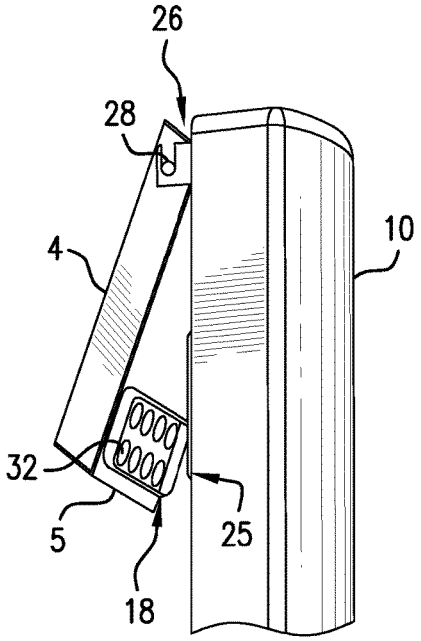
FIG. 3*a* is an isometric view of the integrated RRH/antenna system wherein the RRH is mounted to the antenna.
Figure 3B:
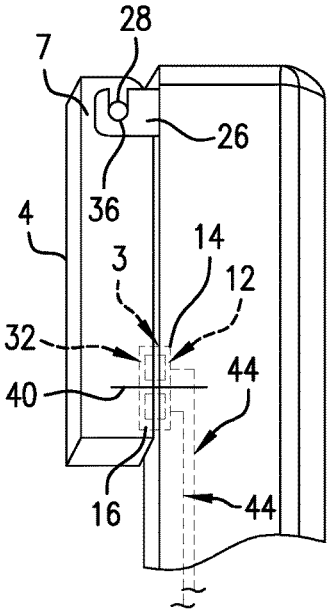
FIG. 3*b* is a broken away, isometric view of the integrated RRH/antenna system wherein a multi-port connector is disposed below the center of gravity of the RRH.

During installation, the RRH is hung from the antenna housing 10 by dropping the horizontal pin 28 of the RRH housing 4 through the opening 34 at the top of the U-shaped bracket 26 and allowing it to come to rest on the bearing surface 36 (See FIGS. 3*a* and 3*b*). The bearing surface 36 facilitates pivoting of the RRH housing 4 and the RRH 42 about the axis of the horizontal pin 28. Once the horizontal pin 28 is resting on the bearing surface 36 of the U-shaped bracket 26, the RRH housing may be pivoted to move the two portions of the connector 3 into face-to-face relationship. Further rotation causes the port aligner 18 to mate with the corresponding surface 25 of the antenna housing 10. Accordingly, the port aligner 18 facilitates sliding engagement of the ports 32 of the RRH 42 with the ports 12 of the antenna 29.

The open-ended clevis allows for rapid deployment and removal of RRH units from service. Another benefit of the disclosed assembly is the ease and speed with which multiple connections between the tower-mounted antenna and the RRH can be made without the aid of special tools.

In this embodiment the port aligner 18 may be made of an elastomeric material to act as a moisture seal when the two portions 14,16 of the connector 3 are coupled together. Pivoting the RRH housing 4 couples the first and second portions 16, 14 of the connector and causes the port aligner 18 to compress and deform against the corresponding surface 25 of the antenna housing 10. The moisture seal blocks the ingress of environmental elements into the connector and the ports 32,12 of the RRH 42 and the antenna 29.

While this embodiment of the integrated RRH/antenna system employs a detachable, pivot-mounted, open-ended clevis to connect the RRH housing 4 to the tower-mounted antenna housing 10, it will be appreciated that other mounting schemes and systems may be employed. For example, each RRH 42 may be disposed within a small cavity or receptacle of the tower-mounted antenna housing 10. In this embodiment, the one connector portion is located at the bottom face 5 of the RRH and the other is located on the bottom face of the cavity such that the weight of the RRH bears down on the connector portions to augment the initial connection and provide a constant biasing force to maintain continuous electrical contact across the connector. As such, the force of gravity augments coupling of the first and second portions of the connector, i.e., the mounting arrangement is "gravity-assisted" to ensure that an electrical connection is made and maintained.

Referring to FIG. 3*b*, the connector 3 is positioned such that the first portion 16 and the second portion 14 are located below the center-of-gravity of the RRH when the two portions are coupled together. Similarly, the force of gravity augments the initial connection between the two portions. Furthermore, the force of gravity provides a constant biasing force to maintain a continuous, positive electrical connection between the RRH ports 32 and the tower-mounted antenna ports 12. The two portions of the connector 3 are coupled together by a slide-on, friction-type connection along a line-of-action (LOA) to establish a positive electrical connection between the RRH ports 32 and the tower-mounted antenna ports 12.

In the fully coupled position, the integrated RRH/antenna system results in a low profile arrangement which reduces the aerodynamic drag in high wind conditions. Accordingly, a larger number of RRHs may be deployed in a cell tower using the configuration disclosed herein before the sail load of the cell tower is reached.

Figure 4C:
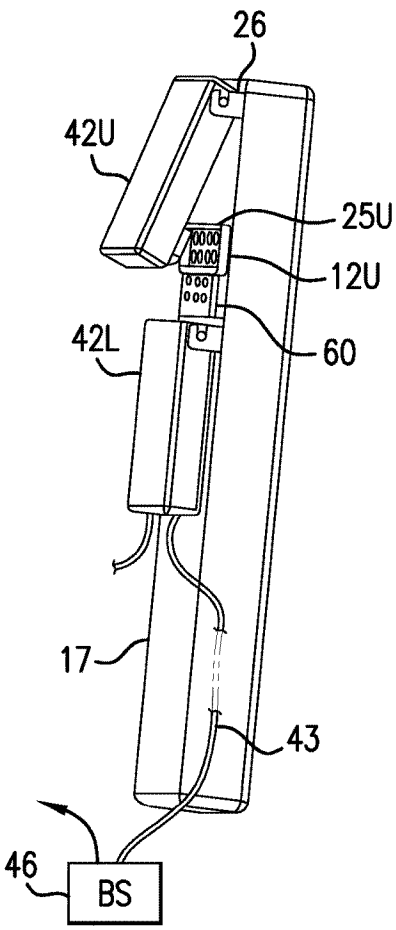
FIG. 4*c* is an isometric view of the integrated RRH/antenna system in combination with a lower base station.
Figure 4B:
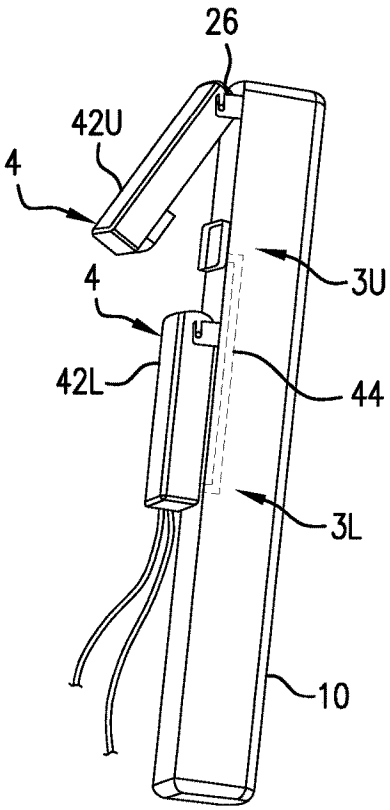
FIG. 4*b* is an isometric view of the integrated RRH/antenna system including internal details of each of the multiport connectors.
Figure 4A:
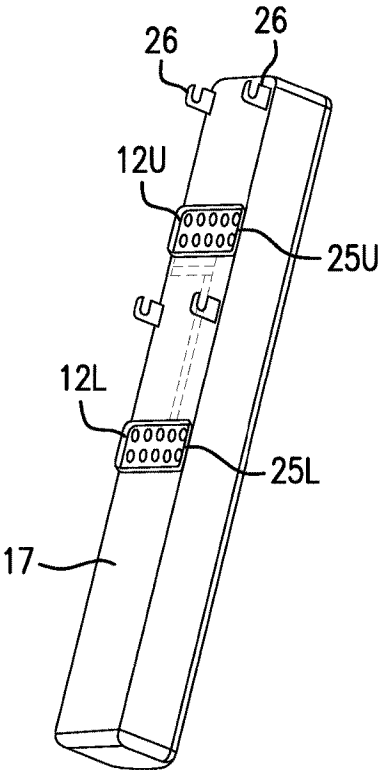
FIG. 4*a* is an isometric view of an isolated antenna having a plurality of multi-port connectors on a surface.

Referring to FIGS. 3*b*, 4*a*, 4*b* and 4*c*, the integrated RRH/antenna system includes multiple radio heads 42U,42L each contained within a RRH housing 4. In this embodiment, the tower-mounted antenna housing 10 includes upper and lower corresponding surfaces 25U, 25L comprising upper and lower ports 12U and 12L, respectively. The lower connector 3L may be coupled to, and receive power and signal data 43 from, the base station components 46. The lower connector 3L may distribute the power and signal data to the other connectors, e.g. an upper connector 3U, through lines 44 disposed internally of the antenna. Furthermore, other Antenna Interface Standards Group (AISG) cables and connector protocols may be run internally from the lower connector 3L to the upper connector 3U. This arrangement also reduces the amount and use of coaxial cable to connect multiple radio heads thereby reducing overall transmission loss between the base station and the tower-mounted antenna. It can be appreciated from the embodiments of FIGS. 4*a* thru 4*c* that the ports 32,12 of the connector 3 can be configured in a variety of ways to accommodate different situations. Referring to FIG. 4*c*, an adapter plate 60 may be disposed over an existing port to provide additional/future connection flexibility.

Figure 5:
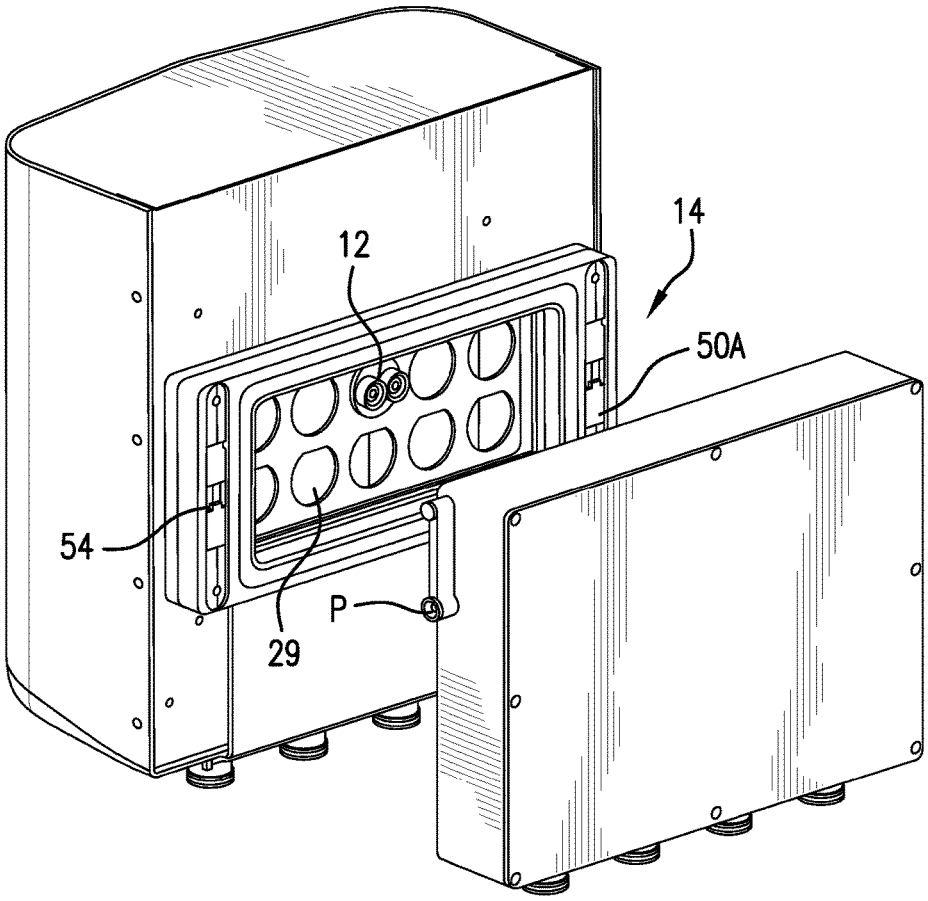
FIG. 5 is an isometric view of a first and second portion of the connector.
Figure 6:
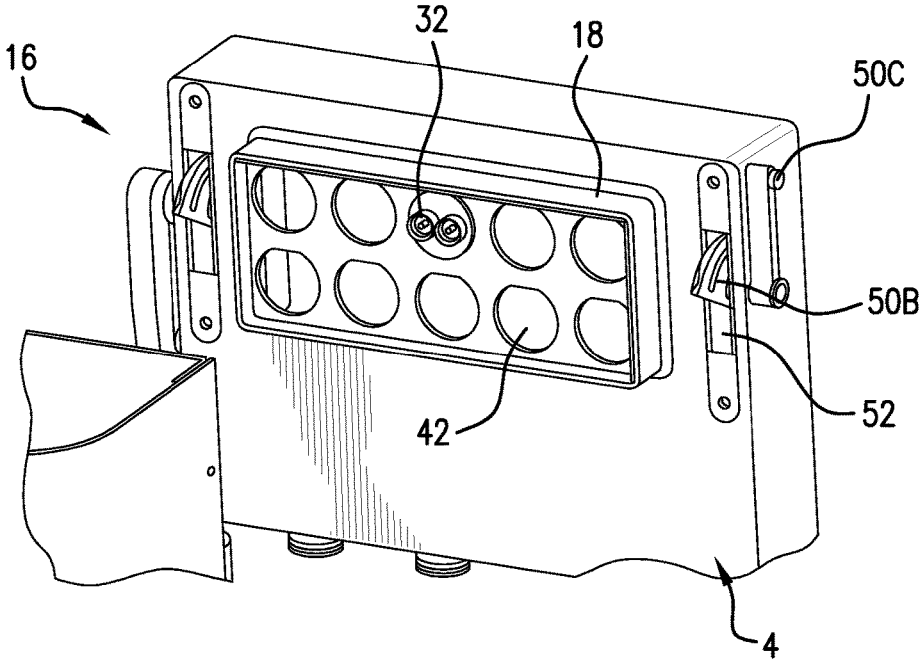
FIG. 6 is an isometric view of at least two connector ports disposed within a portion of the RRH housing.

Referring again to FIG. 3*b*, the first 16 and second portions 14 of the connector 3 are mounted along an interface plane 40 configured to be in face-to-face relationship immediately prior to their engagement. The second portion 14 includes a plurality of holes 31 in the antenna housing through which a plurality of ports 12 may be exposed (See FIGS. 5-6). The embodiment of FIGS. 5-6 includes a connector 3 that is a multi-port connector comprising as many as ten (10) ports disposed on each connector portion 16, 14 for RF data/voice, fiber optics, remote electrical tilt (RET) and AISG. Accordingly, multiple connections as well as multiple types of connections are established simultaneously when the first portion 16 and the second portion 14 are slidably engaged. The sliding engagement compresses the port aligner 18 creating a seal around the multiple ports to prevent the ingress of environmental elements.

A locking arrangement may also be employed to positively couple the first and second portions 16, 14 of the connector after they have been connected to prevent disengagement or decoupling of the connector over time. In this embodiment, the locking arrangement comprises a lever 50*c* that operates a cam 50*b* that may be partially disposed in a slot 52 on the RRH housing 4. A complementary slot is located in the antenna housing 50*a* and also includes a catch 54 that is configured to engage the cam 50*b* when the lever 50*c* is rotated about point P. The engagement of the cam 50*b* with the catch 54 provides a constant biasing force to help maintain a continuous positive electrical connection between the RRH ports 32 and the tower-mounted antenna ports 12. The constant biasing force also serves to further compress the port aligner 18 to prevent the ingress of environmental elements into the connector 3 and connector components.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A remote radio head housing comprising:

a body configured to hold a radio head, the radio head comprising a plurality of radio head ports configured to engage a plurality of antenna ports, the body defining a plurality of openings which provide access to the radio head ports;

a mount engager coupled to the body, the mount engager configured to engage a mount of an antenna housing, and further comprising a rotatable cam configured to provide a biasing force toward the antenna housing, a port aligner coupled to the body, the port aligner configured to mate with a portion of the antenna housing wherein the biasing force provides positive engagement of the remote radio head ports with the antenna ports and compresses the port aligner against the antenna housing to prevent ingress of foreign objects into the plurality of connector components.

2. The remote radio head housing of claim 1, wherein the mount engager and the mount of the antenna housing comprise a pivot mount, the pivot mount configured to detachably mount the body to the antenna housing.

3. The remote radio head housing of claim 2, wherein the pivot mount comprises an open-ended clevis.

4. The remote radio head housing of claim 3, wherein the open-ended clevis comprises:

at least two U-shaped brackets mounted to one of the body and the antenna housing; and a horizontal pin projecting from a surface of one of the body and the antenna housing.

5. The remote radio head housing of claim 4, wherein each U-shaped bracket of the at least two U-shaped brackets defines a bearing surface configured to receive the horizontal pin.

6. The remote radio head housing of claim 1, wherein the plurality of radio head ports are located below a center-of-gravity of the radio head.

7. The remote radio head housing of claim 1, wherein the plurality of radio head ports are configured to facilitate multiple types of connections.

8. A radio head mounting arrangement comprising:

at least one radio head configured to detachably mount to an antenna;

at least one connector including a first portion and a second portion disposed in a face-to-face relationship, the first portion and the second portion being electrically connected to one of the at least one radio head and the antenna, and the first portion and second portion each being located below a center-of-gravity of the at least one radio head, a mount engager coupled to the body and configured to engage a mount of the antenna, and further comprising a rotatable cam configured to provide a biasing force such that the first portion of the connector is biased into toward the second portion of the connector, and a port aligner coupled to the body and configured to mate with a portion of the antenna, wherein the biasing force provides positive engagement of the first and second ports to provide signal continuity and compresses the port aligner against the antenna housing to prevent ingress of foreign objects into the first and second ports.

9. The radio head mounting arrangement of claim 8, wherein the first portion and the second portion are configured to slideably engage each other along a line of action to facilitate radio frequency signal transmission between the at least one radio head and the antenna.

10. The radio head mounting arrangement of claim 8, wherein the at least one radio head is pivot mounted to the antenna.

11. The radio head mounting arrangement of claim 10, wherein the pivot mount comprises an open-ended clevis, the open-ended clevis comprising:

at least two U-shaped brackets mounted to one of the at least one radio head and the antenna; and a horizontal pin projecting from a surface of one of the at least one radio head and the antenna.

12. The radio head mounting arrangement of claim 11, wherein each U-shaped bracket of the at least two U-shaped brackets defines a bearing surface that is configured to receive the horizontal pin.

13. The radio head mounting arrangement of claim 8, wherein the connector includes a plurality of separate ports configured to facilitate multiple types of connections.

* * * * *